United States Patent [19]

Frahme

[11] 4,414,786

[45] Nov. 15, 1983

[54] HEAT INSULATING MODULE FOR HIGH TEMPERATURE CHAMBERS

[76] Inventor: Carl E. Frahme, 26508 Sand Canyon, Canyon Country, Calif. 91351

[21] Appl. No.: 293,970

[22] Filed: Aug. 18, 1981

Related U.S. Application Data

[63] Continuation-in-part of Ser. No. 135,138, Mar. 28, 1980, abandoned.

[51] Int. Cl.[3] ..... E04B 1/38

[52] U.S. Cl. ..... 52/506; 52/474; 52/676; 156/71

[58] Field of Search ..... 52/506–513, 52/270, 474, 676, 404, 698, 741; 65/4 R; 156/71; 110/336; 13/35; 432/247, 248; 264/30

[56] References Cited

U.S. PATENT DOCUMENTS

| | | | |
|---|---|---|---|
| 3,819,468 | 6/1974 | Sauder et al. | 52/270 X |
| 3,832,815 | 9/1974 | Balaz et al. | 52/506 X |
| 3,854,262 | 12/1974 | Brady | 52/506 X |
| 3,892,396 | 7/1975 | Monaghan | 52/506 X |
| 3,930,916 | 1/1976 | Shelley | 52/506 X |
| 3,990,203 | 11/1976 | Greaves | 52/506 X |
| 4,001,996 | 1/1977 | Byrd | 52/506 X |
| 4,062,160 | 12/1977 | Christison | 52/676 X |
| 4,102,103 | 7/1978 | Marcmann | 52/406 |
| 4,120,641 | 10/1978 | Myles | 52/506 X |
| 4,202,148 | 5/1980 | Frahme et al. | 52/592 |

*Primary Examiner*—J. Karl Bell

*Attorney, Agent, or Firm*—Sellers and Brace

[57] ABSTRACT

A heat insulating module for use in lining high temperature chambers and furnaces comprising a thick mat of refractory fibers accreted by vacuum from an aqueous solution on to a mounting subassembly attachable to a chamber wall. The fibers are deposited about and interlocked with one or more anchor members fixed to the mounting subassembly. Larger mounting subassemblies include a reinforcing framework and a reticulated member to which the anchor members are fixed. An alternate mounting subassembly comprises a pair of anchor-equipped strips criss-crossing at right angles and secured together at their mid-lengths. The ends of the strips project beyond the module edges to facilitate securing the module to a chamber wall and include portions which internest with the strip ends of adjacent modules.

36 Claims, 13 Drawing Figures

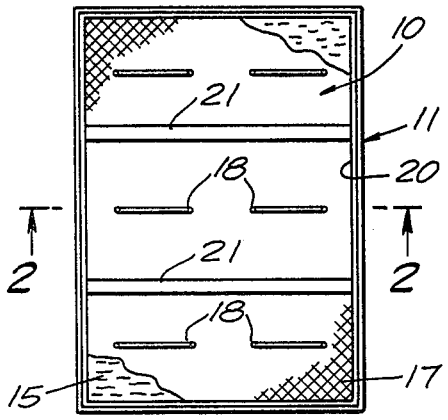
FIG. 1.
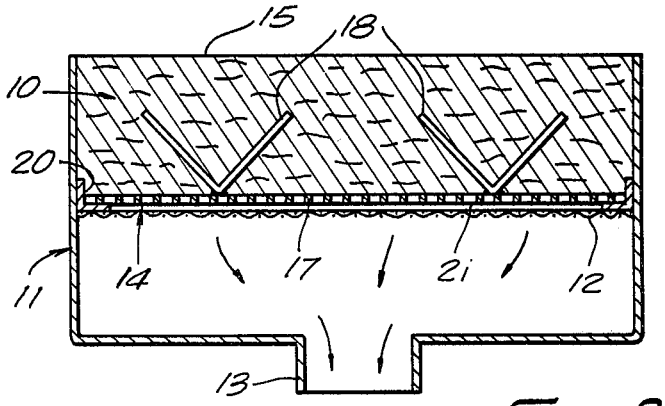
FIG. 2.
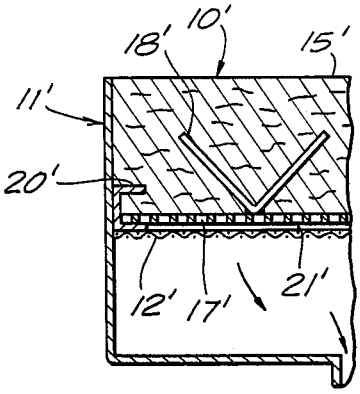
FIG. 3.
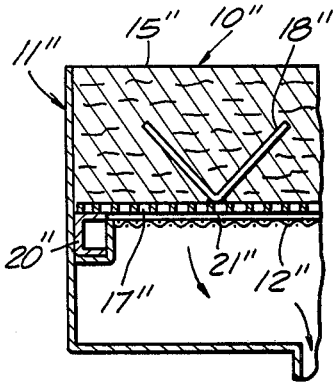
FIG. 4.
FIG. 5.
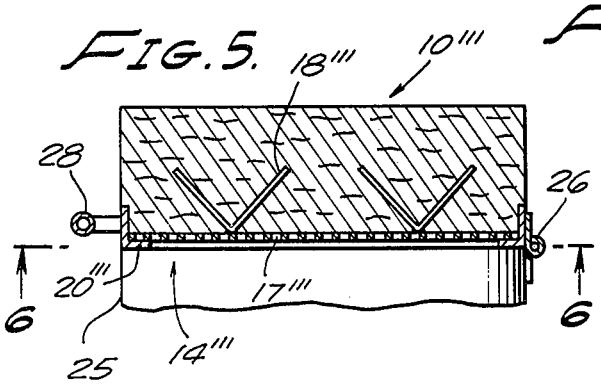
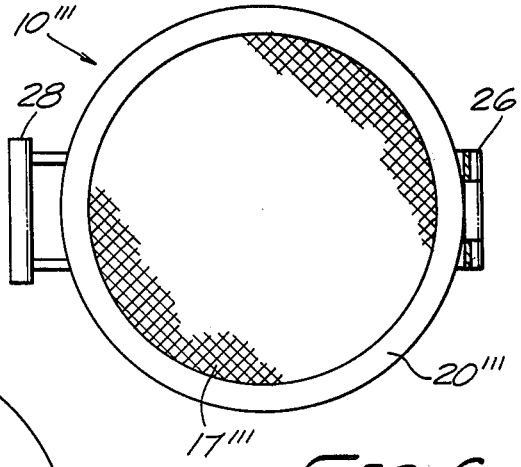
FIG. 6.
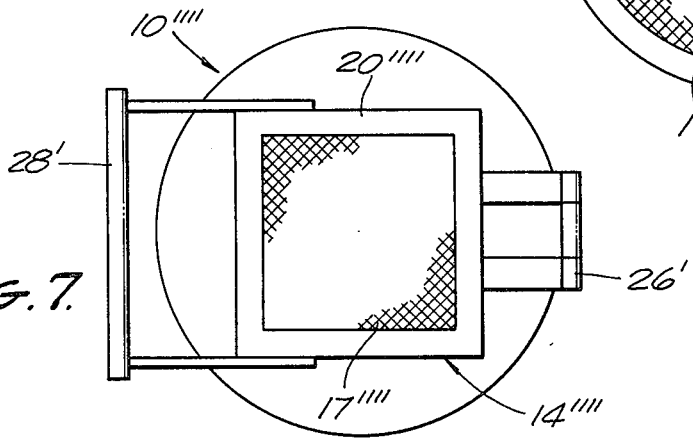
FIG. 7.

FIG. 8.
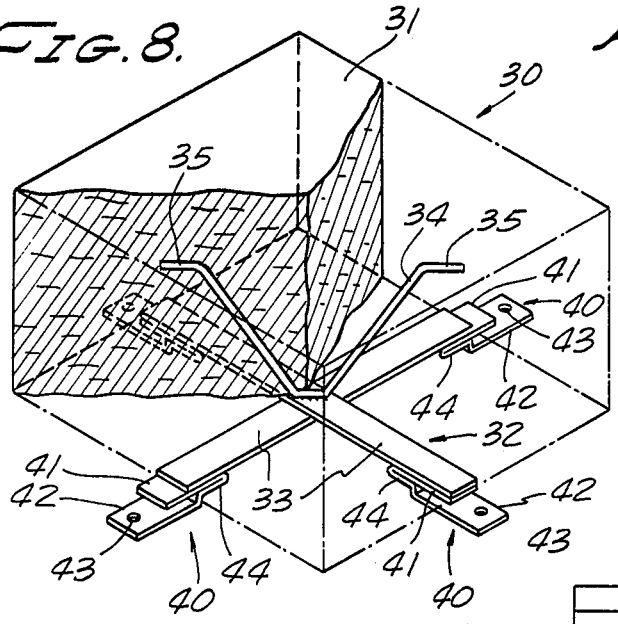
FIG. 13.
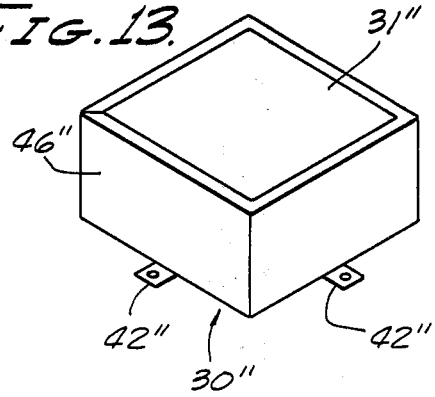
FIG. 10.
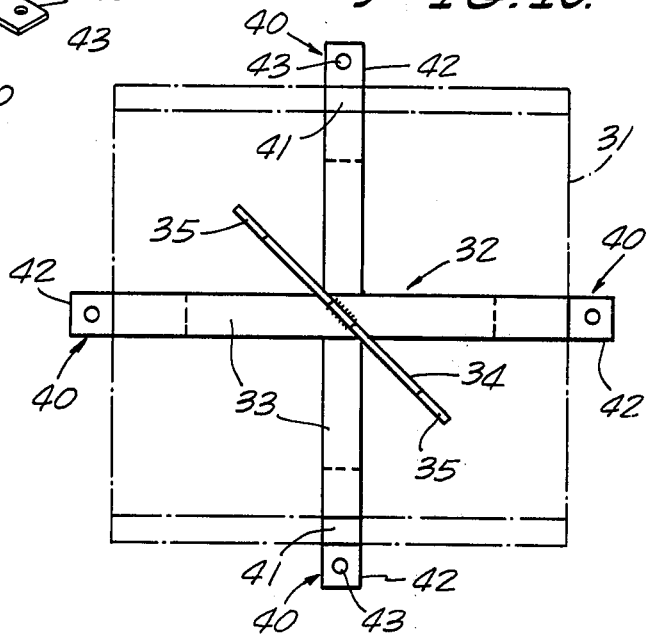
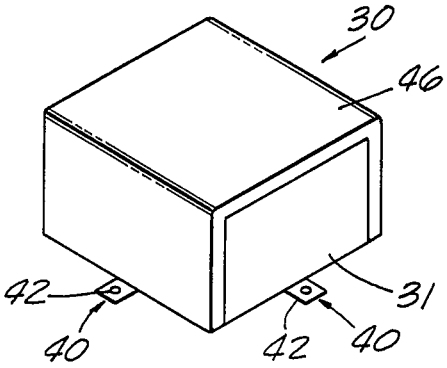
FIG. 9.
FIG. 11.
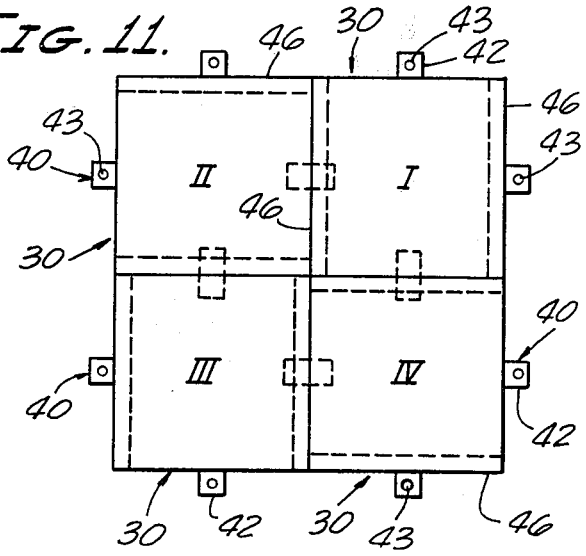
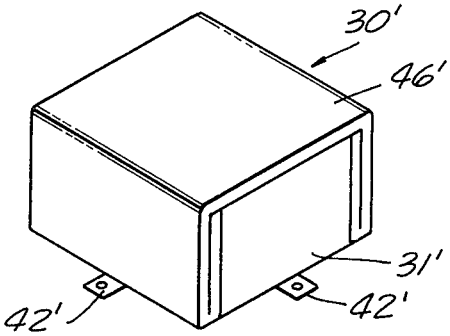
FIG. 12.

HEAT INSULATING MODULE FOR HIGH TEMPERATURE CHAMBERS

This application is a continuation-in-part of my application for U.S. Letters Patent Ser. No. 135,138, filed Mar. 28, 1980, now abandoned, entitled Heat Insulating Module for High Temperature Chambers.

This invention relates to high temperature heat insulating modules, and more particularly to a unique module comprising a thick mat of refractory fibers accreted by vacuum deposition onto a rigid backing and mounting subassembly readily securable to a chamber wall or ceiling.

BACKGROUND OF THE INVENTION

Heat insulating liners for a wide variety of chambers and operating environments present serious problems owing to the high operating temperatures and hostile conditions commonly encountered in such chambers. Traditionally and historically chambers of this type have been lined with various types of bricks, castables or other dense refractories compounded in efforts to withstand high operating temperatures. These linings have many shortcomings and disadvantages well known to those skilled in this art including objectionably high weight, the need for high strength supporting structure, spalling, cracking and shattering, poor thermal properties, high initial assembly, maintenance and replacement costs, high heat storage capacity, poor insulating ability, and others. In recent years lightweight non-rigid linings in a variety of types and construction have come into general use. Certain of these linings are made of ceramic fiber material deposited on a moving conveyor as in the manner disclosed in the U.S. patent to Malone U.S. Pat. No. 3,615,964. Such a blanket has a thickness of a fraction of an inch up to two inches, a density of three to eight pounds per cubic foot and is readily flexed and coiled until ready for use. Another technique involves vacuum forming mats of refractory fibers into convenient size by vacuum deposition from an aqueous slurry. Denser and more compact mats can be made in this manner up to a maximum thickness of two to two and one half inches. Efforts to make thicker mats have not been successful prior to the teachings disclosed in the co-pending U.S. application Ser. No. 919,230, now U.S. Pat. No. 4,202,148, filed June 26, 1978 by Carl E. Frahme and Gary E. Wygant. Heat insulating mats made by either of the aforementioned techniques provide inadequate insulation for many uses unless applied over an existing lining or unless other techniques are resorted to to increase the thickness.

Designers familiar with the aforementioned problems have made a variety of proposals for improved modes of utilizing refractory fiber mats and blanket material. Typical of these are the disclosures in such patents as Sauder U.S. Pat. No. 3,706,870; Sauder U.S. Pat. No. 3,819,468; Balaz U.S. Pat. No. 3,832,815; Brady U.S. Pat. No. 3,854,262; Monaghan U.S. Pat. No. 3,892,396; Shelley U.S. Pat. No. 3,930,916; Sauder U.S. Pat. No. 3,940,244; Byrd U.S. Pat. No. 3,952,470; Greaves U.S. Pat. No. 3,990,203; Sauder U.S. Pat. No. 3,993,237; Byrd U.S. Pat. No. 4,001,996; Woodruff U.S. Pat. No. 4,122,644; Werych U.S. Pat. No. 4,246,852; Werych U.S. Pat. No. 4,249,888 and Dunlap U.S. Pat. No. 4,248,023. For the most part these proposals concern different modes for holding strips of the aforementioned refractory fiber blanket material assembled in strips in side-by-side relation to some type of supporting frame or backing in an assembly operation carried out after forming the mat. In the usual case the mounting is designed to compress the fiber strips transversely of their thickness in order to increase the density and to compensate for shrinkage at higher temperatures. All of these techniques involve objectionably high labor, assembly and material costs and provide a lining product having inferior performance and heat insulating characteristics. Two of the above mentioned patents propose vacuum forming insulating fibers around an anchorage having provision for attaching the resulting module to a furnace wall but each is subject to shortcomings and disadvantages avoided by this invention. The most recent one of the above mentioned prior patents proposes a module the main body of which comprises a stack of individual layers hand assembled and secured together by adhesive or by a metal fastener piercing some or all layers. The metal fastener must be installed subsequent to the assembly of the core layers and the embracing shell further adding to the cost of manufacture.

SUMMARY OF THE INVENTION

The foregoing and other shortcomings and disadvantages of prior proposals have been overcome in a highly satisfactory manner by this invention wherein high density fiber modules of superior quality and uniformity are readily produced with a wall thickness several times greater than that heretofore produceable. It is important that the aqueous slurry in which the mold is suspended during the vacuum forming operation contain a preponderance of long refractory fibers, such as refractory fibers known as spun fibers or their equivalent, since it has been discovered that this is a crucial requirement for the production of refractory mats having a thickness of at least three inches and up to eight and nine inches thick. These fibers are accreted by vacuum deposition onto a suitable mold provided with a suitable backing and mounting subassembly for the module.

In one illustrative embodiment, this subassembly comprises a reticulated sheet metal member to one face of which is fixed a plurality of anchor members having a height substantially less than the thickness of the mat to be deposited thereabout. In larger modules, the reticulated member may and preferably is provided with a reinforcing framework. Expanded metal provides an excellent reticulated member and structural steel components provide a very satisfactory framework. The anchor members may be formed from high strength high temperature resistant metal rods or the like bent in the midlength with their opposite ends flaring away from one another to provide a very firm anchorage between the fiber mat and the reticulated member and are readily secured thereto as by welding. The refractory fiber deposits readily and with uniform density about such anchor members with the result that the components of the module are firmly and inseparably interlocked together.

In another illustrative embodiment, the backing and mounting subassembly consists of a pair of criss-crossing strips secured together at their midlengths and having at least one anchor member fixed thereto and about which the refractory fibers have been vacuum accreted. The strip ends include mounting clips extending beyond each of the peripheral edges of the module. Two of these clips internest with the adjacent clips of an adjacent pair of previously installed modules and another pair remain exposed and accessible for securement to the chamber wall and thereafter in readiness to internest with the mounting clip of the next module. Preferably one or more pairs of the edges of the module is provided with a resilient gasket of refractory fibers to compensate for post-installation shrinkage of the main body of the module commonly occuring when subjected to high operating temperatures. This resilient gasket may comprise a cap embracing all except the wall side of the module and is bonded to the main body of the module.

Accordingly it is a primary object of this invention to provide a unique heat insulating module of inter-bonded high temperature refractory fibers accreted by vacuum deposition to a mounting subassembly.

Another object of the invention is the provision of a liner module for a high temperature chamber comprising a thick mat of interbonded refractory fibers accreted about a plurality of outwardly flaring anchor members secured to a reticulated backing and mounting member.

Another object of the invention is the provision of a high temperature insulating module having a foraminous metal backing member provided with a plurality of flaring anchor members secured to spaced apart points inwardly of its perimeter and embedded in a mat of interbonded refractory fibers to a thickness of at least three inches.

Another object of the invention is the provision of a unique module of refractory fibers accreted by vacuum deposition onto a unitary mounting subassembly having portions thereof embedded in the fibers and other portions criss-crossing the mounting face of the module.

Another object of the invention is the provision of a heat insulating module having a main body of vacuum accreted refractory fibers bonded to a one-piece resilient gasket of refractory fibers on at least one pair of opposed lateral edges thereof.

Another object of the invention is the provision of a heat insulating module having a main body of vacuum accreted refractory fibers bonded to a one-piece resilient blanket of refractory fibers covering at least two opposed lateral edges thereof and which module has a mounting subassembly integral with the module main body with portions thereof projecting beyond the module periphery for internesting engagement with adjacent ones of said modules.

These and other more specific objects will appear upon reading the following specification and claims and upon considering in connection therewith the attached drawing to which they relate.

Referring now to the drawing in which a preferred embodiment of the invention is illustrated:

FIG. 1 is a top plan view if a heat insulating module embodying the principles of this invention with major portion of the refractory mat broken away to show structural details of the mounting and backing subassembly before removal from a vacuum mold;

FIG. 2 is a cross sectional view on an enlarged scale taken along line 2—2 on FIG. 1;

FIGS. 3 and 4 are fragmentary cross sectional views similar to FIG. 2 but showing alternate reinforcing frames;

FIG. 5 is a cross sectional view through a circular module according to this invention suitable for use as a cover for a crucible furnace;

FIG. 6 is a bottom plan view of FIG. 5 taken along line 6—6 on FIG. 5;

FIG. 7 is a view similar to FIG. 6 but showing module for a crucible furnace cover having a modified non-circular reinforcing subassembly.

FIG. 8 is a perspective view of a vacuum molded refractory fiber module with major portions cut away to show details of an alternate mounting subassembly embedded therein;

FIG. 9 is a perspective view on a reduced scale showing a resilient gasket of refractory fibers covering the top and two opposed edges of the FIG. 8 module;

FIG. 10 is a top plan view on an enlarged scale of the module mounting subassembly of FIG. 9;

FIG. 11 is a top plan view showing the parquet assembly technique for mounting the FIG. 9 module on a wall to be insulated; and FIGS. 12 and 13 are views similar to FIG. 9 and showing alternate modes of forming and bonding a resilient gasket of refractory fibers to the main body of the module.

Referring initially to FIGS. 1 and 2, there is shown a heat insulating module embodying the principles of this invention and designated generally 10. As there shown, module 10 has not been removed from its vacuum forming mold 11 having an outlet 13 connectable to a vacuum pump and to a water separator in a manner well known to persons skilled in the formation of fiber mats from an aqueous slurry. The top of such molds is open along a plane contemplated for the finished mat product. Suitably supported crosswise of the interior of mold 11 is a screen 12 which served additionally as a support for the module backing and mounting subassembly 14.

As here shown by way of example, the backing and mounting subassembly 14 includes a reticulated or foraminous member 17 to one face of which are rigidly fixed one or more elongated fiber mat anchor members 18. The free ends of these anchor members lie at an angle to the adjacent portion of the reticulated member 17 to which they are firmly fixed in any suitable manner. As herein shown by way of example, the anchor members 18 are unitary and preshaped with their outer ends flaring away from one another. These ends therefore cooperate with one another and with the inclined ends of adjacent anchor members 18 in fixedly anchoring the refractory fibers thereto and to the reticulated member 17. Expanded metal having slits about one inch long is very satisfactory for member 17. In high temperature applications of the module and typically for temperatures in the range of 1,600° F. to 3,000° F. the anchor members should be made of a high heat resistant material such as a stainless steel alloy. Typical of these is stainless steel 304, 310 or 330 and Inconel 601. V-shaped rods of such material are highly satisfactory because of their effectiveness in anchoring the mat to the reticulated member 17 and also because the fibers are readily accreted about the legs of these rods to provide a mat devoid of voids and of uniform density throughout. Furthermore the anchor members are easily and firmly attached to member 17 by welding or clamping their apexes to the face of this member. In larger size modules member 17 is preferably reinforced by structural steel frame members here shown as embracing the perimeter of member 17 and formed of angle iron. Additional reinforcing may comprise iron straps 21 extending crosswise of the narrower dimension of frame 20 with its edges welded to the adjacent edges of the flanges of frame 20.

Modules 10 are molded to a desired thickness in a single operation. This is carried out by mounting the backing and mounting sub-assembly 14 against the outwardly facing side of screen 12 in mold 11. This mold is then submerged in a slurry of refractory fibers and the mold outlet 12 is connected to a high vacuum source in a manner well known to those skilled in the vacuum accreting art. When forming modules to a thickness of more than 2½ inches it is important that the slurry contain refractory fibers the preponderance of which are three to five or more inches long.

An aqueous slurry formed in accordance with the teachings of the co-pending patent application of Gary E. Wygant and Carl E. Frahme, Ser. No. 919,230, now U.S. Pat. No. 4,202,148, filed June 26, 1978 is eminently satisfactory and the teachings of that application are incorporated herein by reference. Inorganic refractory fibers produced by centrifugal spinning of the molten refractory material and known as spun fibers, or those of equivalent length produced by any other technique are preferred. Such fibers are intermixed with water and a suitable binder well known to persons skilled in this art and maintained in continuous circulation in a slurry tank. Mold 11 containing the mounting sub-assembly for the module is submerged in this slurry and a vacuum is maintained within mold 11 until a mat of fibers of the desired thickness has been accreted to a depth substantially exceeding the height of anchor members 18 above member 17. The molding operation is typically terminated when the mat level reaches the edge of the mold as viewed in FIG. 2 but may be terminated at other stages depending on the mat thickness desired. The mat thickness there shown is about nine inches and the dimensions of the completed module are approximately three feet by four feet. The fibers are deposited randomly in layers and bond to one another at points of contact and crossover. Any tendency toward delamination of these layers is counteracted by the anchor members 18 which extend through the major depth of the mat at an angle to the plane of the layers thereby holding all penetrated layers against separation.

After removal from the mold the mat is thoroughly dried following which the outer surface may be trimmed to provide a finished mat of uniform thickness. The finished mat has a density of 10 to 12 pounds per cubic foot and is suitable for use as a liner for furnace or other high temperature chamber operating at temperatures up to 3,000° F. The module is readily secured against the inner wall of the chamber by clips, hooks, studs or other suitable fastener devices readily secured to frame 20 or to reticulated member 17, or to both.

FIGS. 3 and 4 show two alternate embodiments before removal from the mold and differing from the first described embodiment merely in the nature of the reinforcing frame. Thus, in FIG. 3, the reinforcing frame is formed of channel shaped structural steel 20' embracing the perimeter of the reticulated member 17' which is secured to the outer flange of frame 20'. In the FIG. 4 embodiment, the channel shaped frame 20'' underlies the rear surface of reticulated member 17''. Accordingly, when this module is secured to a furnace chamber the frame 20'' supports the mat in a manner providing a dead air space between it and the outer furnace wall.

In FIGS. 5 and 6, the heat insulating module 10'' there shown differs from the first described embodiment in that the subframe assembly 14''' is circular to provide a module usable as a cover for a crucible furnace 25 to one edge of which it is movably attached by hinge 26. One leaf of this hinge is attached to the vertical flange of reinforcing angle iron 20''' and the other leaf is secured to the outer wall of furnace 25. A handgrip 28 is suitably attached to frame 20''' diametrically opposite hinge 26.

FIG. 7 shows a fourth embodiment wherein the module 10'''' is provided with a backing and mounting subassembly 14'''' of smaller size than the module. It will also be noted that the reticulated member 17'''' is confined within the perimeter of frame 20''''. It will be understood that the downwardly facing surface of the module fiber mat lies flush with the lower surface of frame 20'''' and 17'''' with the result that when the module is utilized as a furnace cover the under surface of the fiber mat will seat flush against the top of furnace chamber 25.

Referring to FIGS. 8 to 12, there is shown several variants of another embodiment of the invention featuring a different module mounting subassembly designed to internest with the similar mounting subassembly of an adjacent module. Referring initially to FIGS. 8–10, there is shown a module designated generally 30 having a vacuum formed core or main body 31 and a unitary mounting subassembly 32. The latter comprises a pair of sheet metal strips 33 which criss-cross one another at right angles and are welded or otherwise secured together at their midlengths. One or more anchor members 34 are welded to strips 33. Typically, the modules may be approximately 12 inches square in which event a single V-shaped anchor member 34 is usually adequate to inseparably anchor mat 31 to strips 33. However, it will be understood that additional anchor members may be welded or otherwise secured to strips 33.

Preferably, a major portion of the length of these anchor members should lie at an angle to the plane of strips 33 to counteract any tendency of the fiber layers of mat 31 to delaminate or separate from one another. This important function is further assisted and assured by bending the outer ends 35 of the anchor members to lie generally parallel to the plane of the fiber layers. As pointed out above, the outer or free ends 35 are positioned sufficiently beneath the front face of mat 31 as not to be damaged by the high temperatures to which this face of the module will be subjected when installed in a high temperature chamber.

Mat 31 is vacuum formed about the anchor member 34 and to the adjacent face of strips 33 in the same general manner described above in connection with FIGS. 1 and 2. This molding operation is carried out before the generally U-shaped clips 40 are attached to the outer ends of strips 33. Mounting assembly 32 is inserted into a mold cavity with its backside resting directly against the mold screen, such as screen 12 in FIG. 2. This screen has a size corresponding to the size of the mat 31 to be molded. A mold containing either single or multiple cells each having a mounting subassembly 32 supported on the screen thereof is then submerged in a slurry of refractory fibers as described above in connection with FIGS. 1 to 4. After a mat of the desired thickness has been vacuum formed, the module is removed from the mold and dried. Thereafter clips 40 are secured to strips 33.

Clips 40 are made from the same strip stock as strips 33 and have closely spaced parallel legs 41, 42 of unequal lengths, leg 42 being about 1 inch longer than leg 41. The protruding end of leg 42 is provided with an opening 40 to receive a fastener, not shown, for securing the module to a chamber wall.

As shown in FIG. 1 the inner ends of legs 41, 42 are flattened against one another as indicated at 44 and this portion is welded or otherwise firmly bonded to the outer face of strips 33. It will be noted from FIG. 8 that clips 40 are secured to the opposite ends of one of the strips 33 with the free end of the short leg 41 protruding about 1 inch beyond the end of strip 33. However, clips 40 are secured to the other strip 33 so that the outer end of leg 41 lies flush with the end of this strip.

The reason for this offset mode of securing the clips 40 to the strips will be apparent from FIG. 9 wherein the main body 31 of the module is shown embraced by an inverted U-shaped resilient blanket 46 of refractory fibers. The thickness of blanket 46 corresponds generally to the portion of clip legs 41 extending beyond the end of one of the strips 33. Blanket 46 is made in a manner well known to those skilled in the art and disclosed for example in U.S. patent to Malone U.S. Pat. No. 3,615,964. Such blankets are quite spongy and resilient and make excellent sealing gaskets for sealing the space between the edges of adjacent modules assembled to provide a void-free lining for a high temperature chamber and are effective to compensate for shrinkage of the main body 31 of the module when subjected to high temperatures. Blanket 46 is secured to mat 31 by a high temperature ceramic cement well known to those skilled in this art.

FIG. 12, shows a slightly modified module 30' formed as described above except that the opposite ends of the resilient blanket or gasket 46' are folded inwardly to provide a double blanket thickness along one pair of opposed lateral edges of mat 31'. It will be noted from FIG. 12 that the pair of clips 40 underlying the double thickness of blanket 46' are secured to the ends of strip 33 so that the longer leg 42' projects about 1 inch beyond the exterior of the overlapped portions of blanket 46'.

FIG. 13 shows another mode of providing the main body 31'' with a resilient gasket 46'' wrapped about all four sides of the main body. In all instances the resilient blanket 46, 46' or 46'' is bonded to the underlying areas of the main body with high temperature ceramic cement. Also each of the finished modules are preferably square to facilitate their assembly parquet-fashion to provide a continuous void-free chamber lining.

FIG. 11 illustrates the manner in which the modules shown in FIG. 9 are assembled to the interior of a high temperature chamber to be insulated. Let it be assumed that the module I, in the upper right hand corner of FIG. 11, is first assembled. This module is secured to a selected area of the chamber wall by inserting a fastener in each of the openings 43 in clips 40. Such fasteners are not shown but may comprise bolts, screws, spot welding or the like. Note that the right and left hand lateral edges of the module are covered by the resilient gasket 46. The workman then proceeds to assemble module II against the left hand edge of the first module but taking care that one of the edges not covered by blanket 36 lies in snug abutting contact with the corresponding portion of the blanket of module I. This assembly is carried out by inserting the longer leg 42 into the seating gap between legs 41 and 42 of module I. The longer leg 42 of module II will lie flush against the outer surface of leg 42 of module I. At this time the remaining three legs of module II are exposed and accessible for securement to the chamber wall. Modules III and IV are then assembled parquet fashion relative to modules I and II. It will be noted that a leg of the resilient gasket or blanket material 46 is pressed snugly against the unblanketed lateral edge of one or more adjacent modules wherein it is effective to compensate for shrinkage of the main body 31 of the modules. Accordingly, when the core of the modules shrinks, the resilient blankets 46 expand to prevent any possibility of a gap opening between the modules.

The module shown in FIG. 12 is assembled parquet fashion in the same manner described above for modules 30. The module shown in FIG. 13 is also assembled in the same manner except the resilient gasket 46'' embraces the entire periphery of the main body 31'' and it is therefore impossible to install this module in an improperly oriented position and any pair of legs 42'' can be internested overlapping the corresponding adjacent leg of another module. It will be recognized that each of the modules shown in FIGS. 8 to 13 is preferably square so that they can be assembled parquet-fashion.

While the particular heat insulating module for high temperature chambers herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

I claim:

1. A heat insulating module for use in high temperature chambers comprising:

a module backing comprising a reticulated member having a plurality of elongated anchor members secured to spaced apart points inwardly of the perimeter of one face thereof before refractory fibers are accreted thereonto with a major portion of said anchor members inclined to said reticulated member; and a thick mat of discrete refractory fibers bonded together by an inorganic bonding agent accreted onto said one face and about said anchor members by vacuum deposition from an aqueous slurry of said refractory fibers to a thickness substantially exceeding the height of said anchor members above said reticulated member.

2. A heat insulating module as defined in claim 1 characterized in that said mat of fibers has a thickness of at least three inches.

3. A heat insulating module as defined in claim 1 characterized in that said reticulated member is secured to a rigid polygonal frame.

4. A heat insulating module as defined in claim 3 characterized in that said frame extends along the perimeter of said module.

5. A heat insulating module as defined in claim 3 characterized in that major portions of said frame are spaced inwardly of the perimeter of said module.

6. A heat insulating module as defined in claim 3 characterized in that said frame is formed in major part of structural metal having longitudinal portions thereof lying at right angles to one another.

7. A heat insulating module as defined in claim 1 characterized in that said reticulated member comprises expanded metal.

8. A heat insulating module as defined in claim 3 characterized in that said polygonal frame is formed of angle iron having one flange parallel to and supporting said reticulated member and the other flange thereof extending from said reticulated member in the same direction as said anchor members.

9. A heat insulating module as defined in claim 1 characterized in that said anchor members comprise rods.

10. A heat insulating module as defined in claim 1 characterized in that the apex of said anchor members is welded to said reticulated member.

11. A heat insulating module as defined in claim 1 characterized in that said frame has a hinge fixed to one side thereof and a hand grip fixed to the opposite side thereof whereby said module is adapted to be used as a hinged cover for a high temperature chamber.

12. A heat insulating module as defined in claim 1 characterized in that said anchor members have a plurality of legs joined to said module backing by common securing means.

13. A heat insulating module as defined in claim 12 characterized in that said anchor member legs are inclined relative to one another and relative to said reticulated member.

14. A heat insulating module as defined in claim 13 characterized in that said anchor members are V shaped and secured to said reticulated member adjacent the apex thereof.

15. A liner module for securement to the interior of a high temperature chamber comprising:

a backing and mounting sub-assembly comprising a reticulated member provided with a polygonal rigid frame secured to the perimeter portion thereof;

a plurality of generally elongated anchor members having the mid-length thereof fixed to one face of said reticulated member at spaced apart points inwardly of the perimeter thereof before the accretion of refractory fibers thereabout and with the free end portion of said anchor members terminating in a plane intermediate the front and rear surfaces of said module and lying at an angle to one another and to the front surface of said module; and a mat of interbonded high temperature refractory fibers accreted onto the surface of said reticulated member and about said anchor members to a depth very substantially in excess of the height of said anchor members by vacuum deposition from an aqueous slurry of said fibers.

16. A high temperature chamber liner module as defined in claim 15 characterized in that said mat of refractory fibers has a density of about 10 to 12 pounds per cubic foot.

17. A high temperature chamber liner module as defined in claim 15 characterized in that said mat is three to nine inches thick.

18. A high temperature chamber liner module as defined in claim 15 characterized in that said refractory fibers can withstand temmperatures ranging between 1,600° and 3,000° F.

19. A liner module as defined in claim 15 characterized in that said opposite ends of said anchor members are inclined to said reticulated member so as to become embedded in and immovably anchored thereto by the accretion of refractory fibers thereabout.

20. A liner module as defined in claim 19 characterized in that the opposite ends of said anchor members diverge from one another.

21. A liner module as defined in claim 19 characterized in that said anchor members are generally V-shaped with the apex thereof secured to said reticulated member.

22. A heat insulating module for securement to the interior of a high temperature chamber comprising:

a thick mat of discrete refractory fibers bonded together by an inorganic bonding agent and accreted by vacuum deposition from an aqueous slurry of said refractory fibers to form a mat having generally parallel front and rear faces;

unitary means immovably impaled in said mat of fibers as the same are accreted to form said mat and useful in securing said mat to the interior of a high temperature chamber, said unitary means including (1) a rigid mounting member lying snugly against the rear face of said mat and (2) at least one elongated metallic anchor member preassembled to said mounting member before the accretion of said fibers to form said mat;

said anchor member being formed of high temperature resistant metal and being embedded in and surrounded by said fibers with the portions thereof remote from said mounting member spaced very substantially inwardly from the front face of said mat and having major portions thereof inclined acutely to the front and rear faces of said mat and cooperating to resist movement of said anchor member in all directions relative to said mat of fibers.

23. A heat insulating module as defined in claim 22 characterized in that said anchor member is a rod having the mid-length thereof secured to said mounting member and the opposite ends thereof diverging from one another.

24. A heat insulating module as defined in claim 22 characterized in the provision of a plurality of said mounting members criss-crossing one another flush against the rear face of said mat and secured together at the area of cross over, and the end of said mounting members terminating adjacent a respective edge of said mat.

25. A heat insulating module as defined in claim 24 characterized in that said mounting members each comprise a strip of metal having the ends thereof shaped to internest with the complementally shaped strip end of an adjacent one of said modules to form a heat insulating lining for a high temperature chamber.

26. A heat insulating module as defined in claim 22 characterized in the provision of a plurality of said anchor members secured to said mounting member with all portions thereof embodied in said mat and spaced inwardly from the peripheral edges and from the front face thereof.

27. A heat insulating module as defined in claim 22 characterized in that said mounting member is reticulated and generally coextensive with the rear face of said mat.

28. A heat insulating module as defined in claim 22 characterized in that the opposite ends of said mounting member include a portion protruding beyond the adjacent edge of said mat and constructed to internest with the outer end of a similar mounting member of another one of said modules when assembled in edge to edge contact with one another, and the protruding portion of said mounting member being accessible for securement to the interior of a chamber wall.

29. A heat insulating module as defined in claim 28 characterized in that said mat is provided with a plurality of said mounting strips each having the opposite ends thereof constructed to internest with the similarly constructed end of the mounting member of another of said modules.

30. A heat insulating module as defined in claim 22 characterized in that one pair of opposed edges thereof includes a resilient layer of refractory fibers secured thereto and effective to compensate for shrinkage of the vacuum accreted portion thereof when subjected to high temperature.

31. A heat insulating module as defined in claim 30 characterized in that said module and the resilient layers on at least one pair of opposed edges thereof has a square perimeter and is adapted to be assembled parquet fashion to other similar modules.

32. A heat insulating module as defined in claim 30 characterized in the provision of a thick resilient layer of refractory fibers secured to all perimeter edges thereof.

33. A heat insulating module as defined in claim 22 characterized in that said pair of resilient layers of refractory fibers are interconnected by a resilient layer of said fibers secured to and covering said front face of said thick mat.

34. A heat insulating module for securement to the interior of a high temperature chamber comprising:

a thick mat of discrete refractory fibers bonded together by an inorganic bonding agent and accreted by vacuum deposition from an aqueous slurry of said refractory fibers to form a mat having generally parallel front and rear faces; and anchor means impaled in said mat during the vacuum formation thereof including rigid mounting means lying snugly against the rear face of said mat and including internesting means protruding from a respective edge of said mat constructed and arranged to mate with the mounting means of another similarly constructed module, said mounting means including a portion protruding outwardly beyond the edge of said mat for securement to a chamber wall before the telescopic assembly thereof to the mounting means of another of said modules.

35. A heat insulating module as defined in claim 34 characterized in that said mounting means is U-shaped with the parallel legs closely spaced from one another and including a longer leg protruding beyond the adjacent edge of said module and adapted to be secured to a chamber wall, and the other of said legs terminating generally flush with the adjacent edge of said module.

36. A heat insulating module as defined in claim 35 characterized in the provision of a thick resilient blanket of refractory fibers bonded to at least one pair of opposed edges of said mat, and said mounting means including a portion protruding outwardly beyond the outer surface of said resilient blanket for securing said module to a chamber wall and positioned for internesting assembly to the mounting means of another similarly constructed module.

* * * * *